United States Patent [19]

Bloch et al.

[11] Patent Number: 4,549,457

[45] Date of Patent: Oct. 29, 1985

[54] TIP IN EQUALIZING APPARATUS

[75] Inventors: Alf L. Bloch, Pleasant Ridge; Joseph H. Tindall, Rochester, both of Mich.

[73] Assignee: West Industries, Inc., Troy, Mich.

[21] Appl. No.: 488,336

[22] Filed: Apr. 25, 1983

[51] Int. Cl.[4] ..... B26F 1/02

[52] U.S. Cl. ..... 83/582; 72/465; 83/623; 219/89

[58] Field of Search ..... 83/582, 623; 72/465; 219/86.61, 89; 100/231, 264

[56] References Cited

U.S. PATENT DOCUMENTS 3,008,034 11/1961 Wolfbauer, Jr. ..... 219/89

4,098,161 7/1978 Bloch ..... 83/519

*Primary Examiner*—James M. Meister

*Attorney, Agent, or Firm*—Cullen, Sloman, Cantor, Grauer, Scott & Rutherford

[57] ABSTRACT

A compact apparatus for applying equal force to opposite sides of a workpiece including an arm mounted on a frame for movement in a plane to be rotated into alignment with the workpiece. The arm is moveably connected to the frame and is guided into position to engage the workpiece by tracks and followers. The workpiece is engaged on opposite sides by a tool and an anvil which perform an operation thereon. The forces applied by the tool and the anvil are equalized by a pivotable member to prevent distortion of the workpiece while performing the operation. The pivotable member engages a biasing spring which is connected to the frame on its lower end and engages the arm on its upper end to urge the arm in one direction relative to the frame.

15 Claims, 4 Drawing Figures

TIP IN EQUALIZING APPARATUS

BACKGROUND OF THE INVENTION

1. Technical Field

This invention relates to an apparatus which is moveable to engage opposite sides of a workpiece to perform fabricating operations. More specifically, the apparatus has a tool and anvil which are moveable to engage opposite sides of the workpiece with equal pressure.

2. Prior Art

Various prior art patents have disclosed different apparatus for applying equalized pressure to opposite surfaces of a workpiece during fabrication operations. Such patents include U.S. Pat. Nos. 3,270,640; 3,299,247; 3,396,260; 3,008,032; 3,008,034; 3,136,879; and 4,098,161; each being incorporated herein by reference. In each of the above patents means are provided to equalize the forces applyed to the workpiece to minimize or eliminate distortion of the workpiece when fabricating operations are performed.

Prior tools having equalizing systems are complex apparatus having a linearly displaced tool which is interconnected with an anvil or tool backup member. The interconnection between the tool and anvil have previously included a biasing means, such as a spring, and frame members which are linearly slidable relative to each other. Generally, prior equalizing systems used elongate biasing means which are mounted on the tool parallel to the direction of tool movement. The linearly slidable frame members are used to interconnect the tool to the biasing means. As a result the prior art tools are elongate members that are difficult to maneuver into position to engage a workpiece.

In many situations it is necessary to move such an apparatus into engagement with a workpiece. For instance, on an automobile assembly line the workpiece is typically a partially assembled automobile which is continuously moved along an assembly line. Apparatus used on assembly lines must be maneuverable into position to perform an operation on the automobile and then retracted from the automobile as it moves down the line. Elongate shaped apparatus are cumbersome to maneuver into position for assembly line operations.

The prior art fails to disclose a simply constructed compact apparatus which is effective to align a tool and anvil on opposite sides of a workpiece. U.S. Pat. No. 3,008,034 to Wolfbauer discloses an apparatus for tilting a tool having an equalizing system into position to engage a workpiece. The apparatus disclosed in Wolfbauer in an elongate member having parallel force applying means and equalizing means which are interengaged by linearly moveable frame members. As a result the device is bulky and consequently difficult to maneuver into position. The Wolfbauer apparatus is a welding gun having opposed electrodes mounted on two separate frame members. The frame members of the Wolfbauer welding gun are slidable relative to each other with one of the frame members engaging the gun drive mechanism while the other frame member engages the equalizing system. The frame members are relatively slidable to equalize the pressure exerted by the two opposed electrodes on the workpiece. As such, the Wolfbauer device includes a large number of moveable parts which are subject to wear. As the moveable parts wear, the accuracy of the tool is reduced. The tipping mechanism of the Wolfbauer device includes cam slots that are open to the exterior of the device which allows foreign matter to be deposited on the cam surfaces. Foreign matter on the cam surfaces can lead to accelerated wear of the cam surfaces. In addition, since the cam slots extend completely through the frame members the frame members are weakened making the device subject to distortion from bending stresses developed in the operation of the device.

Accordingly, the prior art has evidenced certain shortcomings and disadvantages when applied to fabrication operations in which the tool must be maneuvered into position to operate on a workpiece.

SUMMARY OF THE INVENTION

The present invention overcomes the shortcomings and disadvantages of the prior art by an apparatus which features an improved equalizing system using a pivoting member to interconnect a supporting frame to an arm which holds a tool and anvil.

In general operation, the tool and anvil are mounted on a unitary arm to engage opposite surfaces of a workpiece. The force exerted by the tool and anvil are balanced to minimize workpiece distortion by means of a force applied through the pivoting member to the arm. The improved equalizing system comprises a spring member rigidly connected to the frame which applies a force to the pivoting member. The pivoting member pushes against the arm to urge the anvil toward the workpiece while the tool is being driven in the opposite direction. The force equalization system is adjustable so that the forces applied by the tool and anvil can be balanced. This arrangement eliminates the need for longitudinally moveable frame members which interconnect the arm with the equalizing means thereby allowing the apparatus to be more compact and of simpler construction.

Another feature of the present invention is the provision of guide means having substantially enclosed running surfaces. The guide means include cam tracks which guide the movement of the arm. The cam tracks are substantially internally oriented to prevent foreign material from being deposited thereon. By internally orienting the cam tracks, wear of the cam surfaces caused by foreign material abrading the cam surfaces as the guide means operate is minimized.

The internally oriented cam tracks of the present invention do not extend completely through the frame. Therefore, the frame is able to maintain its structural strength without additional reinforcements. As a result several guide tracks may be co-located in close proximity to one another allowing the tool to be both durable and compact.

The equalizing system of the present invention also acts to hold the guide means in firm engagement with the cam tracks during the operating cycle. This forces the arm to move precisely within the predetermined path of motion defined by the cam tracks.

The present invention provides various improvements and advantages over the prior art. For example and not by way of limitation: (1) the equalizing system allows the tool to be simple and compact; (2) the pivotable lever of the equalizing means eliminates the need for linearly moveable frame members which interconnect the arm to the frame; (3) the deposit of foreign material on the cam surfaces is minimized by internally orienting the cam surfaces; (4) the biasing force exerted by the equalizing means on the guide means assures precise control of arm movement; (5) balancing the forces exerted by the tool and anvil is simplified by the use of a single hydraulic cylinder and biasing means; and (6) the sturdy construction of the apparatus provides a long service life.

Although the apparatus is described in the environment of a punch operation, it should be appreciated that the equalizing system and guide means are adaptable to many different types of fabrication operations. Accordingly, the following description should be construed as exemplarly instead of in a limiting sense.

BRIEF DESCRIPTION OF THE DRAWINGS

The various objects and benefits of the present invention will be more readily understood upon reading the following detailed description of the invention in conjunction with the drawings and appended claims.

In the drawings, wherein like reference numerals identify corresponding parts.

DETAILED DESCRIPTION OF THE PREFERRED EMBODIMENT

Figure 1:
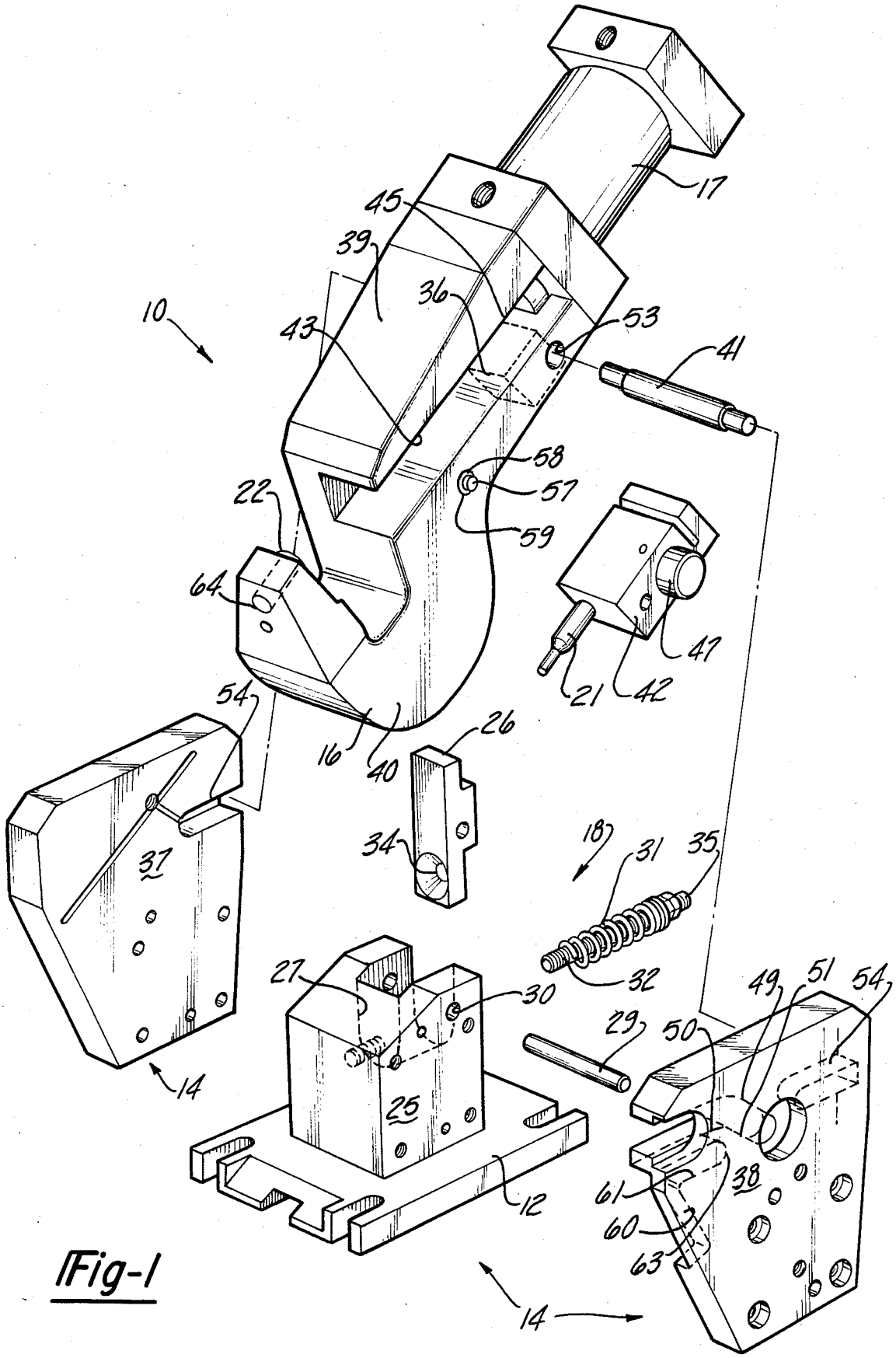
FIG. 1 is an exploded pictorial view of the apparatus disclosed in the present invention diagrammatically illustrating a channel to receive the pivotable lever.

Referring to FIG. 1, the apparatus is generally indicated by the reference numeral 10 and includes a base plate 12 which is adapted to attach the apparatus to a mounting surface (not shown). A frame 14 is rigidly connected to the base plate 12 and is adapted to support the arm 16 for movement in a plane. A hydraulic cylinder 17 is connected to one end of the arm 16 to provide a power means for operating the tool 10. The arm 16 and frame 14 are moveably interconnected by an equalizing system 18 and guide means. The arm 16 is a unitary member which holds a tool 21 and an anvil 22 in alignment for performing operations on a workpiece 24.

In the disclosed embodiment, the tool 21 is a punch and the anvil 22 is a die button. The punch is an elongate member having a sharp end for cutting a hole in the workpiece with a linear motion. The die button is an annular member commonly used to support a workpiece as a hole is punched therethrough.

The arm 16 is moveably mounted so that it may be tipped downwardly on one end to clear an edge of a workpiece 24 as it is moved into an operative position relative thereto. The arm of the tool is tipped up after clearing the edge to perform an operation on the workpiece 24. After the operation has been performed the arm is tipped downwardly to once again clear the edge of the workpiece as the arm is retracted.

The equalizing system 18 is provided to balance the pressure exerted on opposite sides of the workpiece 24 by the tool 21 and anvil 22. The equalizing system 18 comprises an equalizer block 25 which forms an integral part of the frame 14. The equalizer block 25 is adapted to receive a pivotable lever 26 within a cavity 27. The pivotable lever 26 is mounted on a pivot pin 29 to pivot within the cavity 27. The pivot pin 29 is received within a bore 30 which crosses the cavity 27. The equalizing system further comprises a biasing means or spring 31 which is disposed about a rod 32 that is rigidly connected to the equalizer block 25. The rod 32 extends across the cavity 27 perpendicular to and spaced below the pivot pin 29.

The pivotable lever 26 includes an opening 34 on its lower end for receiving the rod 32 therethrough in a non-interferring relationship. In the disclosed embodiment the opening 34 is tapered to prevent contact with the rod 32. Inner end of the spring 31 engages the lever 26 adjacent the opening 34 and exerts a biasing force on the lever 26 toward the workpiece 24. A stop assembly 35 is provided on the end of the rod extending out of the cavity 23 to engage the outer end of the spring 31 to hold it in compression on the rod 32. Preferably, the stop assembly 35 is adjustable to control the biasing force exerted by the spring 31 on the lever 26. The upper end of the lever 26 extends out of the cavity 27 to engage the arm 16. The upper end of the lever 26 extends into a channel 36 formed in the lower rear portion of the arm 16 which is located immediately above the equalizer block 2. The channel 36 provides clearance for movement of the lever 26. The upper end of the lever 26 engages the pivot pin 41 to transfer the biasing force exerted by the spring 31 to the arm 16. The pivoting movement of the lever 26 changes the biasing force directed toward the workpiece 24 on the lower end of the lever to a biasing force directed away from the workpiece being applied to the arm 16.

The frame 14 comprises a side plate 37 and a cam plate 38 which extend from opposite sides of the equalizer block 25 in the same direction to enclose two sides of the arm 16 and define a planar space in which the arm 16 is moveable. The arm 16 moves in a path defined by guide means located on the side plate 37 and the cam plate 38. The path of arm movement can be changed by changing the configuration of the guide means.

The arm 16 may be specially designed to suit a given application. In the disclosed embodiment the arm is a hooked shaped member having a generally rectangular central portion 39 and a U-shaped operating end 40 at the opposite end of the central portion 39 from the cylinder 17.

A ram 42 is slidably disposed within the central portion 39 of the arm 16 in a slide channel 43. The ram 42 is adapted to retain the punch 21 on one end and is operatively connected on its other end to the piston rod 45 of the hydraulic cylinder 17. The ram 42 moves within the slide channel 43 which is formed longitudinally in the central portion 39. A cam roller 47 extends from the side of the ram 42 nearest to the cam plate 38 to engage a cam track 49 formed in the cam plate 38.

The cam track 49 controls the path of arm movement during the tipping motion and approach motion of the tool 10. The cam track 49 is a slot formed in the internal surface of the cam plate 38. The slot is U-shaped in cross-section having two sides and a base. One of the sides is a cam surface upon which the cam roller moves. If desired, the cam surface may be hardened to resist wear. The cam track 49 may be shaped to guide the arm 16 through any prescribed set of movements. In the disclosed embodiment the cam track 49 includes a straight portion 50 and an inclined portion 51. The cam roller 47 moves in the inclined portion 51 to guide the arm 16 through the tipping movement and in the straight portion 50 as the ram 42 approaches the workpiece 24.

A pivot pin 41 supports the rear portion of the arm 16 in the frame 14. The pivot pin 41 extends through the arm 16 in a bore 53 having an axis parallel to the pivot pin 29 of the lever 26. The ends of the pivot pin 41 are received within a pivot pin track 54 formed in the side plate 37 and the cam plate 38. In the disclosed embodiment each pivot pin track 54 in an elongate U-shaped slot having two sides and a base. The pivot pin track 54 is straight and runs parallel to the slide channel 43 to allow the arm 16 to slide toward or away from the workpiece 24 depending upon the arm location at which the tool 21 and anvil 22 exert equal pressure on the workpiece 24.

A rotatable pin 57 is mounted in the front of the arm 16 to assist in guiding the arm 16 during its tipping motion. The rotatable pin 57 is received within a journal bearing 58 which rotatably supports the pin 57. The rotatable pin 57 is oriented with its axis of rotation parallel to and spaced from the pivot pin 41. The journal bearing 58 is disposed within a bore 59 formed near the front of the central portion 39 of the arm 16. The journal bearing 58 is provided to reduce wear and rotational friction incurred by the pin 57 as it rotates relative to the bearing 58. Rotatable pin 57 extends from the arm 16 on the side adjacent the cam plate 38 and is received within the guide track 63 formed in the cam plate 38.

The guide track 63 is provided to guide the movement of the arm 16 along a predetermined path. The guide track 63 of the disclosed embodiment includes an inclined portion 60 and a straight portion 61 which runs parallel to the slide channel 43. The rotatable pin 57 moves in the inclined portion 60 to guide the arm 16 through the tipping movement. The rotatable pin 57 moves in the straight portion 61 to allow the arm 16 to move relative to the workpiece 24 until it reaches the position at which the tool 21 and anvil 22 exert equal pressure upon the workpiece 24.

The straight portions 50 and 61 of the cam track 49 and guide track 63 respectively and the pivot pin track 54 are all parallel to the slide channel 43 as the tool 21 approaches the anvil 22. As a result of this alignment the arm 16 is moveable toward or away from the workpiece 24 depending on whether the tool 21 or anvil 22 is first to engage the workpiece 24. The equalizing system 18 urges the entire arm 16 away from the workpiece 24 by force exerted through the pivotable lever 26 while the hydraulic cylinder 17 forces the tool 21 toward the workpiece 24.

In the disclosed embodiment, the guide track 63, cam truck 49 and pivot pin track 54 are formed in the internal surface of the cam plate 38 and do not extend to the outer surface. A substantial thickness of material is left between the base of the groove and the outer surface of the cam plate 38 to reinforce the cam plate in this region. The material left in this area prevents distortion or deformation of the cam plate 38 by operation of the apparatus 10. The inherent strength of this construction allows the guide track 63 and cam track 49 to be located in close proximity to one another, adding to the compactness of the tool. An additional advantage of this construction is that the internal orientation of the slots inhibits the deposit of foreign material in the cam track. This is important since foreign material in the cam track could cause the cam surface to wear at an accelerated rate.

When the anvil is a die button the operating end 40 of the arm 16 also includes a bore 64 extending through the arm behind the die button. The bore 64 is provided to allow fragments of metal removed by the tool 21, or punch, to be shed from the apparatus 10.

OPERATION

Figure 2:
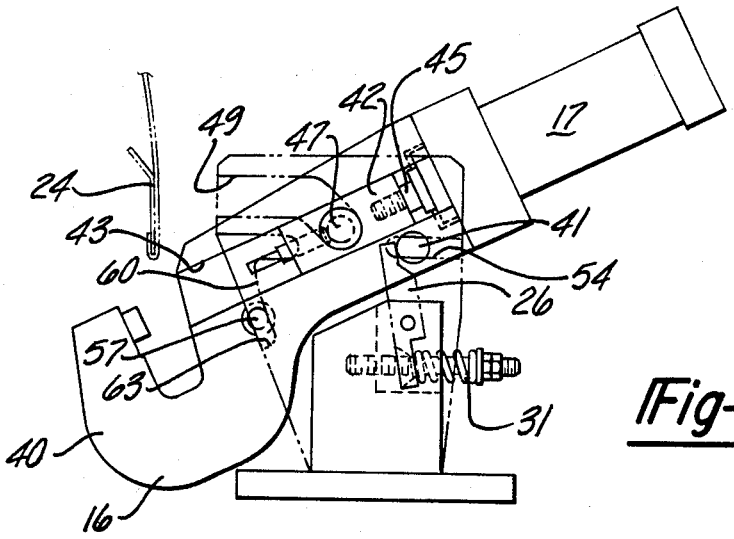
FIG. 2 is a partially fragmentized side elevational view of the apparatus in the tipped position.

The operation of the apparatus 10 will be described with reference to FIGS. 2 through 4. When the apparatus 10 is in its initial position as shown in FIG. 2 the left side of the arm 16 is tipped downwardly for the apparatus 10 to approach the workpiece 24. The open part of the U-shaped operating end 40 is tilted to permit the anvil 22 to be placed on the opposite side of the workpiece 24 from the tool 21. In this position the piston rod 45 of the hydraulic cylinder 17 is fully retracted. The ram 42 is attached to the piston rod 45 and is held at the end of the slide channel 43 nearest the hydraulic cylinder 17. The cam roller 47 is at the lowest end of the cam track 49 while the rotatable pin 57 is disposed in the lower portion of the guide track 63. The lever 26 extends into the channel 36 and engages the pivot pin 41 of the arm 16. The lever 26 is held in compression by the spring 31 thereby holding the pin 57 in firm engagement with the inclined portion of the guide track 63.

Figure 3:
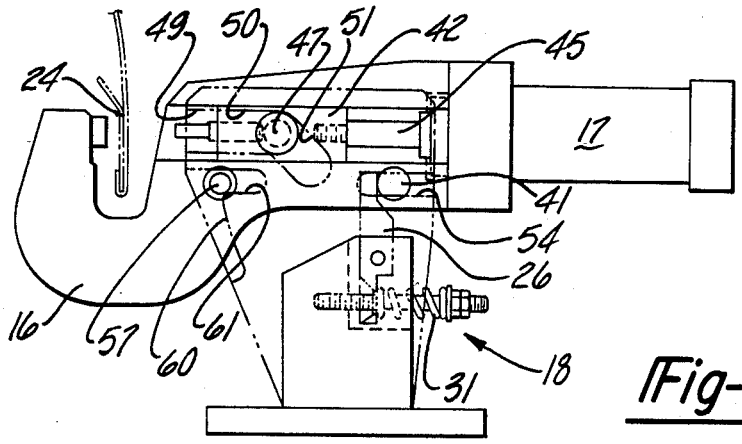
FIG. 3 is a partially fragmentized side elevational view of the apparatus as the tool approaches the portion of the workpiece to be operated upon.

As shown in FIG. 3, as the cycle begins the hydraulic cylinder 17 forces the piston rod 45 toward the workpiece, from right to left as illustrated. The ram 42 slides within the slide channel 43 toward the workpiece and drives the cam roller 47 up the cam track 49 until the straight portion 50 of the cam track 49 is in alignment with the slide channel 43. As the cam roller 47 moves up the inclined portion 51 it causes the arm 16 to pivot clockwise about the pivot pin 40 simultaneously causing the rotatable pin 57 to roll up the guide track 63 until it reaches the straight portion 61. It should be noted that at this point the straight portions 50 and 61 are engaged by the cam roller 47 and rotatable pin 57 respectively. The tool 21 and anvil 22 are now properly aligned with the workpiece 24 to perform the required operation, in this case, punching a hole in the workpiece 24. The equalizing system 18 is now able to move the arm 16 by applying a force directed toward the workpiece 24 through the lever 26 to the arm 16 to move it from left to right as the ram 42 continues to move toward the workpiece 24, from right to left as illustrated. When the arm 16 moves from left to right the anvil 22 moves toward the inner side of the workpiece 24.

Figure 4:
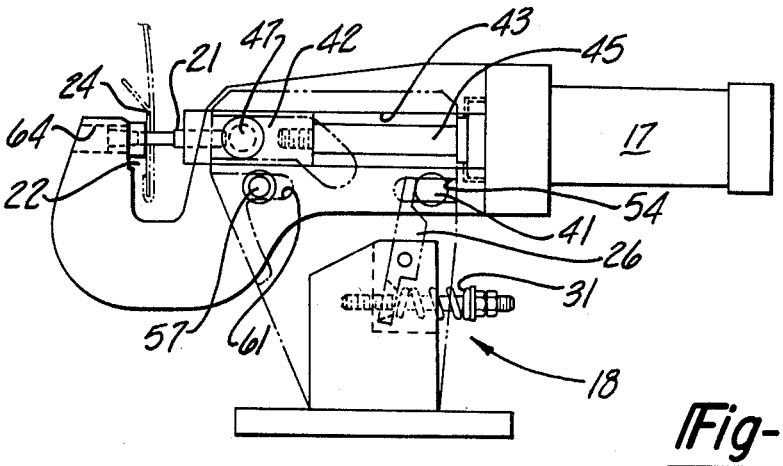
FIG. 4 is a partially fragmentized side elevational view of the apparatus with the tool fully extended and the workpiece being engaged by the tool and the anvil for performing the desired operation.

As shown in FIG. 4 the hydraulic cylinder 17 continues to force the piston rod 45 from right to left pushing the ram 42 within the slide channel 43 toward the workpiece 24. The pivot pin 41, cam roller 47 and rotatable pin 57 move in their respective tracks to the equalization point wherein the tool 21 and anvil 22 contact the workpiece 24 with equal force. The equalizing system has a scissor-like centering action in which work is not performed on an object until both working elements engage opposite sides of the object. If the tool 21 engages the workpiece 24 first, the force applied by the hydraulic cylinder 17 is combined with the force of the spring 31 to move the arm from left to right until the anvil 22 engages the opposite side of the workpiece 24. If the anvil 22 contacts the workpiece 24 prior to the tool 21, the equalizing system 18 holds the anvil 22 and the arm 16 in place until the tool 21 contacts the workpiece 24. The force exerted by the tool 21 or anvil 22 alone on the workpiece 24 should not be sufficient to deform the workpiece.

If the tool 21 is a punch it is driven through the workpiece only after both the punch and die button engage opposite sides of the workpiece 24. The punch forces a small fragment of scrap metal through the die button and into the bore 64. If desired, a pneumatic device (not shown) may be operatively connected to the bore 64 to assist in the removal of the fragments of metal. Otherwise, the fragment will drop through the bore 64 when the arm is tilted counterclockwise on the return stroke.

After the punching operation has been completed, the hydraulic cylinder 17 begins its return stroke which is a mere reversal of the above steps. On the return stroke the arm 16 pivots counterclockwise following the same path of motion in reverse and out of engagement with the workpiece 24. When the tilted position shown in FIG. 2 is reached the apparatus is ready for the next cycle.

As will be appreciated, various modifications and additions can be made without departing from the invention. The tool 21 and the anvil 22 may be opposed electrodes of a resistance welder that are connected by shunts to a welding circuit. If the apparatus is used as a resistance welding tool the tool and anvil must be insulated from each other to be operative.

If the tool 10 is to be used as a rivet gun the anvil 22 will retain the head of the rivet while the end of the rivet is deformed by the tool. However, it is foreseeable that the function of the anvil and tool may be reversed in rivet gun applications.

In general, the invention may be applied to any type of tool in which operations are performed on a workpiece wherein opposite sides of a workpiece are engaged by a tool and anvil.

Other modifications and additions can be made within the scope of the invention. For example, alternative power means may be used instead of the hydraulic cylinder. Likewise, alternative biasing means, such as a hydraulic shock absorber, may be used instead of the compression spring.

The invention may be further developed within the scope of the following claims. Accordingly, the above specification is to be interpreted as being illustrative of an operative embodiment of the present invention rather than in a strictly limited sense.

I now claim:

1. An apparatus for performing operations on a workpiece, comprising:

a frame adapted to be secured to a mounting surface;

an arm having an anvil and a tool mounted for reciprocal movement on said arm relative to said anvil;

cam and follower means for guiding the movement of said arm in one plane relative to the frame;

power means operatively connected to said tool for reciprocating said tool relative to said workpiece;

a biasing member interconnected with said frame;

lever means having a first end engaging said biasing member and a second end engaging said arm for pivotably transferring pressure applied to said first end by said biasing member to said arm thereby equalizing the force applied by said tool and said anvil upon opposite sides of a workpiece while performing operations on the workpiece.

2. The apparatus of claim 1 wherein said biasing member is a helical spring disposed on a rod extending substantially parallel to the direction of the reciprocal movement of the ram.

3. The apparatus of claim 2 wherein said lever means includes an opening on the first end for receiving said rod therethrough in non-interfering relationship and a surface on said first end for contacting said helical spring.

4. The apparatus of claim 3 wherein said rod includes means for adjusting the biasing force said helical spring exerts upon said surface on said first end of the lever means.

5. The apparatus of claim 1 wherein said cam and follower means comprises:

a first cam surface formed on said frame;

a ram connected to said power means and adapted to retain said tool;

first follower means extending from said ram toward said frame for following said first cam surface;

a second cam surface formed on said frame;

second follower means extending from said arm toward said frame for following said second cam surface;

a third cam surface formed on said frame; and third follower means extending from said arm toward said frame for following said third cam surface.

6. The apparatus of claim 5 wherein said first and second cam surfaces are defined by one side of first and second grooves which are open toward said arm wherein said cam surfaces are substantially internal to said arm.

7. The apparatus of claim 6 wherein said first, second and third cam surfaces each include a straight portion which extends parallel to the direction of the reciprocating movement of said tool, wherein each of said straight portions are simultaneously engaged by said first, second and third follower means.

8. The apparatus of claim 5 wherein said third follower means is constantly engaged by the lever means to exert a pressure on said third follower means away from said workpiece, said pressure being sufficient to move said arm away from said workpiece until said tool and said anvil exert substantially equal pressure on opposite sides of said workpiece.

9. The apparatus of claim 1 wherein said tool is a punch and said anvil is a die button.

10. A force applying apparatus for performing operations on a workpiece having opposed sides comprising a frame adapted to be mounted on a surface, a hook shaped arm having a U-shaped portion and an elongate portion, said arm being shiftably mounted on said frame for movement in a plane, track means interconnecting said frame and said arm for guiding the movement of said arm, a ram shiftably mounted on said arm, cylinder means being operatively attached to the ram for reciprocally driving said ram, a tool retained by and partially extending from said ram toward said U-shaped portion, said tool being adapted to engage one side of said workpiece, an anvil mounted on said U-shaped portion in alignment with said tool and being adapted to engage an opposite side of said workpiece, equalizing means interconnecting the arm to the frame for balancing pressure exerted on said workpiece by said tool and said anvil on said opposed sides wherein the improvement comprises:

said equalizing means being a pivotable member which engages said arm on one end and a biasing member attached to said frame on the opposite end for urging said elongate portion of said arm away from said workpiece as said tool approaches said one side of the workpiece and said anvil approaches said opposite side of the workpiece.

11. In the apparatus of claim 10, wherein said arm is a unitary structure.

12. In the apparatus of claim 10, wherein said track means comprises a cam roller extending from one side of said ram into a cam track formed in said frame, a pivot pin extending from said arm perpendicularly to the plane of movement of said arm, said pivot pin being received in a track extending parallel to the direction in which said tool holder reciprocates, wherein said pivotable member engages said pivot pin to urge said pivot pin to move in said track and said cam roller to move in said cam track away from said workpiece.

13. In the apparatus of claim 12, wherein said track means further comprises a rotatably mounted pin extending perpendicular to the plane of movement of said arm to engage a second cam track formed in said frame, said rotatably mounted pin and second cam track being effective to guide the movement of said arm relative to said frame.

14. In the apparatus of claim 13, wherein said second cam track has a first cam surface parallel to the track and a second cam surface extending from the first cam surface at an angle, said second cam surface being spaced from the point said pivotable member engages said pivot pin thereby causing said pivotable member to maintain said biasing means in compression during a portion of the operating cycle.

15. In the apparatus of claim 10 wherein said tool is a punch and said anvil is a die button.

* * * * *